US010502478B2

(12) United States Patent
Avhale et al.

(10) Patent No.: US 10,502,478 B2
(45) Date of Patent: Dec. 10, 2019

(54) HEAT REJECTION SYSTEM FOR A CONDENSER OF A REFRIGERANT LOOP WITHIN AN APPLIANCE

(71) Applicant: WHIRLPOOL CORPORATION, Benton Harbor, MI (US)

(72) Inventors: Amit A. Avhale, St. Joseph, MI (US); Bruno Boehringer, Benton Harbor, MI (US); Darci Cavali, St. Joseph, MI (US); E. C. Pickles, St. Joseph, MI (US); Vijaykumar Sathyamurthi, Stevensville, MI (US); Lihan Xu, St. Joseph, MI (US); Yan Zhang, Iowa City, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 269 days.

(21) Appl. No.: 15/384,980

(22) Filed: Dec. 20, 2016

(65) Prior Publication Data

US 2018/0172335 A1 Jun. 21, 2018

(51) Int. Cl.
*F25D 11/00* (2006.01)
*F25D 23/00* (2006.01)
(Continued)

(52) U.S. Cl.
CPC ..... *F25D 23/003* (2013.01); *F25D 11/02* (2013.01); *F25B 9/04* (2013.01); *F25B 39/04* (2013.01);
(Continued)

(58) Field of Classification Search
CPC ..... F25D 2323/0022; F25D 23/003; F25D 2323/00261; F25D 2323/00263; F25D 2323/00267; F25B 2500/12; F25B 9/04
See application file for complete search history.

(56) References Cited

U.S. PATENT DOCUMENTS 2,515,825 A 7/1950 Grant
2,873,041 A 2/1959 Allen
(Continued)

FOREIGN PATENT DOCUMENTS

CN 101967746 A 2/2011
CN 105177914 A 12/2015
(Continued)

*Primary Examiner* — Frantz F Jules
*Assistant Examiner* — Lionel Nouketcha
(74) *Attorney, Agent, or Firm* — Price Heneveld LLP

(57) ABSTRACT

A refrigerator includes a cabinet defining a refrigerated compartment and a machine compartment. A compressor is disposed within the machine compartment and is adapted to compress a refrigerant within a refrigerant line. A micro-channel condenser is positioned in communication with the compressor and adapted to selectively reject heat from the refrigerant into the machine compartment. A condenser fan is positioned within the machine compartment between the condenser and compressor. The fan is adapted to draw heated air through the condenser and also draw fresh air from an area adjacent the machine compartment and beneath the refrigerated compartment. The heated air and fresh air combine to define mixed air that is directed toward the compressor for cooling the compressor.

20 Claims, 11 Drawing Sheets

(51) Int. Cl.
*F25D 11/02* (2006.01)
*F25B 9/04* (2006.01)
*F25B 39/04* (2006.01)

(52) U.S. Cl.
CPC ..... *F25B 2400/073* (2013.01); *F25B 2500/12* (2013.01); *F25D 2323/0022* (2013.01); *F25D 2323/00261* (2013.01); *F25D 2323/00263* (2013.01); *F25D 2323/00267* (2013.01)

(56) References Cited

U.S. PATENT DOCUMENTS 2,934,023 A 4/1960 Lamkin et al.
3,142,162 A * 7/1964 Herndon, Jr. ..... F25D 23/006 248/613
3,162,023 A * 12/1964 Smith ..... F25D 23/003 62/155
3,196,553 A 7/1965 Deaton et al.
3,218,730 A 11/1965 Menk et al.
3,342,961 A 9/1967 Deaton et al.
3,653,807 A 4/1972 Platt
3,805,404 A 4/1974 Gould
3,953,146 A 4/1976 Sowards
3,999,304 A 12/1976 Doty
4,134,518 A 1/1979 Menchen
4,137,647 A 2/1979 Clark, Jr.
4,260,876 A 4/1981 Hochheiser
4,261,179 A 4/1981 Dageford
4,860,921 A 8/1989 Gidseg
4,870,735 A 10/1989 Jahr, Jr. et al.
5,285,664 A 2/1994 Chang et al.
5,592,829 A * 1/1997 Kim ..... F25B 39/04 165/67
5,600,966 A 2/1997 Valence et al.
5,628,122 A 5/1997 Spinardi
5,666,817 A 9/1997 Schulak et al.
5,720,536 A 2/1998 Jenkins et al.
5,927,095 A 7/1999 Lee
5,946,934 A 9/1999 Kim et al.
5,979,174 A 11/1999 Kim et al.
6,041,606 A 3/2000 Kim
6,073,458 A 6/2000 Kim
6,401,482 B1 6/2002 Lee et al.
6,598,410 B2 7/2003 Temmyo et al.
6,793,010 B1 9/2004 Manole
6,957,501 B2 10/2005 Park et al.
6,973,799 B2 12/2005 Kuehl et al.
6,983,615 B2 1/2006 Winders et al.
7,008,032 B2 3/2006 Chekal et al.
7,055,262 B2 6/2006 Goldberg et al.
7,093,453 B2 8/2006 Asan et al.
7,117,612 B2 10/2006 Slutsky et al.
7,127,904 B2 10/2006 Schmid
7,143,605 B2 12/2006 Rohrer et al.
7,162,812 B2 1/2007 Cimetta et al.
7,181,921 B2 2/2007 Nuiding
7,207,181 B2 4/2007 Murray et al.
7,216,506 B2 * 5/2007 Shin ..... F25D 23/003 62/448
7,254,960 B2 8/2007 Schmid et al.
7,281,387 B2 * 10/2007 Daddis, Jr. ..... A47F 3/0408 165/110
7,504,784 B2 3/2009 Asada et al.
7,610,773 B2 11/2009 Rafalovich et al.
7,624,514 B2 12/2009 Konabe et al.
7,665,225 B2 2/2010 Goldberg et al.
7,707,860 B2 5/2010 Hong et al.
7,775,065 B2 8/2010 Ouseph et al.
7,866,057 B2 1/2011 Grunert et al.
7,895,771 B2 3/2011 Prajescu et al.
7,934,695 B2 5/2011 Sim et al.
7,980,093 B2 7/2011 Kuehl et al.
8,024,948 B2 9/2011 Kitamura et al.
8,056,254 B2 11/2011 Loffler et al.
8,074,469 B2 12/2011 Hamel et al.
8,079,157 B2 12/2011 Balerdi Azpilicueta et al.
8,099,975 B2 1/2012 Rafalovich et al.
8,104,191 B2 1/2012 Ricklefs et al.
8,166,669 B2 5/2012 Park et al.
8,182,612 B2 5/2012 Grunert
8,240,064 B2 8/2012 Steffens
8,245,347 B2 8/2012 Goldberg et al.
8,266,813 B2 9/2012 Grunert et al.
8,266,824 B2 9/2012 Steiner
8,276,293 B2 10/2012 Ricklefs et al.
8,377,224 B2 2/2013 Grunert
8,382,887 B1 2/2013 Alsaffar
8,434,317 B2 5/2013 Besore
8,438,750 B2 5/2013 Dittmer et al.
8,484,862 B2 7/2013 Nawrot et al.
8,572,862 B2 11/2013 TeGrotenhuis
8,590,337 B2 * 11/2013 Lafaire ..... F25D 23/003 165/149
8,601,830 B2 12/2013 Lee et al.
8,615,895 B2 12/2013 Shin et al.
8,656,604 B2 2/2014 Ediger et al.
8,667,705 B2 3/2014 Shin et al.
8,695,230 B2 4/2014 Noh et al.
8,770,682 B2 7/2014 Lee et al.
8,789,287 B2 7/2014 Kim et al.
8,789,290 B2 7/2014 Grunert
8,857,071 B2 10/2014 Lee et al.
8,910,394 B2 12/2014 Steffens
8,915,104 B2 12/2014 Beihoff et al.
8,984,767 B2 3/2015 Grunert et al.
9,010,145 B2 4/2015 Lim et al.
9,022,228 B2 5/2015 Grunert
9,027,256 B2 5/2015 Kim et al.
9,027,371 B2 5/2015 Beihoff et al.
9,052,142 B2 6/2015 Kim et al.
9,062,410 B2 6/2015 Ahn et al.
9,085,843 B2 7/2015 Doh et al.
9,103,569 B2 8/2015 Cur et al.
9,134,067 B2 9/2015 Ahn et al.
9,140,472 B2 9/2015 Shin et al.
9,140,481 B2 9/2015 Cur et al.
9,212,450 B2 12/2015 Grunert et al.
9,249,538 B2 2/2016 Bison et al.
9,267,725 B2 * 2/2016 Jeon ..... F25D 11/02
9,299,332 B2 3/2016 Je
9,303,882 B2 4/2016 Hancock
9,328,448 B2 5/2016 Doh et al.
9,328,449 B2 5/2016 Doh et al.
9,334,601 B2 5/2016 Doh et al.
9,335,095 B2 5/2016 Bison et al.
9,356,542 B2 5/2016 Ragogna et al.
9,359,714 B2 6/2016 Contarini et al.
9,372,031 B2 6/2016 Contarini et al.
9,435,069 B2 9/2016 Contarini et al.
9,487,910 B2 11/2016 Huang et al.
9,506,689 B2 11/2016 Carbajal et al.
9,534,329 B2 1/2017 Contarini et al.
9,534,340 B2 1/2017 Cavarretta et al.
9,605,375 B2 3/2017 Frank et al.
9,644,306 B2 5/2017 Doh et al.
9,663,894 B2 5/2017 Kim et al.
2004/0139757 A1 7/2004 Kuehl et al.
2005/0178139 A1 * 8/2005 Kim ..... F25D 21/04 62/277
2005/0217139 A1 10/2005 Hong
2005/0229614 A1 10/2005 Ansted
2006/0070385 A1 4/2006 Narayanamurthy et al.
2006/0144076 A1 7/2006 Daddis, Jr. et al.
2006/0196217 A1 9/2006 Duarte et al.
2007/0033962 A1 2/2007 Kang et al.
2008/0141699 A1 6/2008 Rafalovich et al.
2008/0196266 A1 8/2008 Jung et al.
2008/0307823 A1 12/2008 Lee et al.
2009/0071032 A1 3/2009 Kreutzfeldt et al.
2009/0158767 A1 6/2009 McMillin
2009/0158768 A1 6/2009 Rafalovich et al.
2009/0165491 A1 7/2009 Rafalovich et al.
2009/0260371 A1 10/2009 Kuehl et al.
2009/0266089 A1 10/2009 Haussmann

(56) References Cited

U.S. PATENT DOCUMENTS

| | | | | |
|---|---|---|---|---|
| 2010/0011608 | A1 | 1/2010 | Grunert et al. | |
| 2010/0101606 | A1 | 4/2010 | Grunert | |
| 2010/0107703 | A1 | 5/2010 | Hisano et al. | |
| 2010/0146809 | A1 | 6/2010 | Grunert et al. | |
| 2010/0154240 | A1 | 6/2010 | Grunert | |
| 2010/0212368 | A1 | 8/2010 | Kim et al. | |
| 2010/0230081 | A1 | 9/2010 | Becnel et al. | |
| 2010/0258275 | A1 | 10/2010 | Koenig et al. | |
| 2010/0288471 | A1 | 11/2010 | Summerer | |
| 2011/0011119 | A1 | 1/2011 | Kuehl et al. | |
| 2011/0030238 | A1 | 2/2011 | Nawrot et al. | |
| 2011/0036556 | A1 | 2/2011 | Bison et al. | |
| 2011/0072849 | A1 | 3/2011 | Kuehl et al. | |
| 2011/0209484 | A1 | 9/2011 | Krausch et al. | |
| 2011/0209860 | A1 | 9/2011 | Koenig et al. | |
| 2011/0277334 | A1 | 11/2011 | Lee et al. | |
| 2011/0280736 | A1 | 11/2011 | Lee et al. | |
| 2012/0017456 | A1 | 1/2012 | Grunert | |
| 2012/0266627 | A1 | 10/2012 | Lee | |
| 2012/0272689 | A1 | 11/2012 | Elger et al. | |
| 2013/0008049 | A1 | 1/2013 | Patil | |
| 2013/0104946 | A1 | 5/2013 | Grunert et al. | |
| 2013/0111941 | A1 | 5/2013 | Yu et al. | |
| 2013/0195678 | A1* | 8/2013 | Yoo | F04D 27/005 417/45 |
| 2013/0212894 | A1 | 8/2013 | Kim et al. | |
| 2013/0255094 | A1 | 10/2013 | Bommels et al. | |
| 2013/0263630 | A1 | 10/2013 | Doh et al. | |
| 2013/0276327 | A1 | 10/2013 | Doh et al. | |
| 2013/0318813 | A1 | 12/2013 | Hong et al. | |
| 2013/0340797 | A1 | 12/2013 | Bommels et al. | |
| 2014/0020260 | A1 | 1/2014 | Carow et al. | |
| 2014/0026433 | A1 | 1/2014 | Bison et al. | |
| 2014/0075682 | A1 | 3/2014 | Filippetti et al. | |
| 2014/0109428 | A1 | 4/2014 | Kim et al. | |
| 2014/0190032 | A1 | 7/2014 | Lee et al. | |
| 2014/0216706 | A1 | 8/2014 | Melton et al. | |
| 2014/0260356 | A1 | 9/2014 | Wu | |
| 2014/0290091 | A1 | 10/2014 | Bison et al. | |
| 2014/0366397 | A1 | 12/2014 | Wakizaka et al. | |
| 2015/0015133 | A1 | 1/2015 | Carbajal et al. | |
| 2015/0033806 | A1 | 2/2015 | Cerrato et al. | |
| 2015/0114600 | A1 | 4/2015 | Chen et al. | |
| 2015/0285551 | A1 | 10/2015 | Aiken et al. | |
| 2015/0308034 | A1 | 10/2015 | Cavarretta et al. | |
| 2015/0322618 | A1 | 11/2015 | Bisaro et al. | |
| 2016/0010271 | A1 | 1/2016 | Shin et al. | |
| 2016/0040350 | A1 | 2/2016 | Xu et al. | |
| 2016/0083894 | A1 | 3/2016 | Bison et al. | |
| 2016/0083896 | A1 | 3/2016 | Ryoo et al. | |
| 2016/0115636 | A1 | 4/2016 | Kim et al. | |
| 2016/0115639 | A1 | 4/2016 | Kim et al. | |
| 2016/0138208 | A1 | 5/2016 | Bison et al. | |
| 2016/0138209 | A1 | 5/2016 | Kitayama et al. | |
| 2016/0145793 | A1 | 5/2016 | Ryoo et al. | |
| 2016/0169540 | A1 | 6/2016 | Hancock | |
| 2016/0178267 | A1 | 6/2016 | Hao et al. | |
| 2016/0186374 | A1 | 6/2016 | Ryoo et al. | |
| 2016/0258671 | A1 | 9/2016 | Allard et al. | |
| 2016/0265833 | A1 | 9/2016 | Yoon et al. | |
| 2016/0282032 | A1 | 9/2016 | Gomes et al. | |
| 2016/0290702 | A1 | 10/2016 | Sexton et al. | |
| 2016/0305696 | A1 | 10/2016 | Kobayashi et al. | |
| 2016/0348957 | A1 | 12/2016 | Hitzelberger et al. | |

FOREIGN PATENT DOCUMENTS

| | | | | |
|---|---|---|---|---|
| CN | 105696291 | A | 6/2016 | |
| DE | 3147796 | | 3/1983 | |
| DE | 3738031 | A1 | 5/1989 | |
| DE | 4304372 | A1 | 8/1994 | |
| DE | 4409607 | A1 | 10/1994 | |
| DE | 10002742 | C1 | 6/2001 | |
| DE | 10116238 | B4 | 3/2005 | |
| DE | 10002743 | B4 | 1/2006 | |
| DE | 102005041145 | A1 | 3/2007 | |
| DE | 102006018469 | A1 | 10/2007 | |
| DE | 102007052835 | A1 | 5/2009 | |
| DE | 102008033388 | A1 | 1/2010 | |
| DE | 102008054832 | A1 | 7/2010 | |
| DE | 102009046921 | | 5/2011 | |
| DE | 102012223777 | A1 | 6/2014 | |
| DE | 112012006737 | T5 | 4/2015 | |
| EP | 468573 | A1 | 1/1992 | |
| EP | 0816549 | A2 | 1/1998 | |
| EP | 999302 | A1 | 5/2000 | |
| EP | 1055767 | A1 | 11/2000 | |
| EP | 1987190 | A1 | 11/2008 | |
| EP | 2134896 | B1 | 12/2009 | |
| EP | 2189568 | A1 | 5/2010 | |
| EP | 2202349 | | 6/2010 | |
| EP | 2284310 | A1 | 2/2011 | |
| EP | 2324152 | B1 | 5/2011 | |
| EP | 2341178 | A1 | 7/2011 | |
| EP | 2386679 | | 11/2011 | |
| EP | 2455526 | A1 | 5/2012 | |
| EP | 2466001 | A1 | 6/2012 | |
| EP | 2497856 | A1 | 9/2012 | |
| EP | 2559805 | A1 | 2/2013 | |
| EP | 2581489 | A1 | 4/2013 | |
| EP | 2612964 | A1 | 7/2013 | |
| EP | 2612965 | A1 | 7/2013 | |
| EP | 2612966 | A1 | 7/2013 | |
| EP | 2634301 | A1 | 9/2013 | |
| EP | 2708636 | A1 | 3/2014 | |
| EP | 2708639 | A1 | 3/2014 | |
| EP | 2733257 | A1 | 5/2014 | |
| EP | 2746455 | A1 | 6/2014 | |
| EP | 2594687 | B1 | 9/2014 | |
| EP | 2966215 | | 1/2016 | |
| EP | 2993427 | | 3/2016 | |
| EP | 3015594 | A1 | 5/2016 | |
| EP | 2468949 | B1 | 6/2016 | |
| EP | 3034675 | A1 | 6/2016 | |
| EP | 3241944 | | 11/2017 | |
| GB | 2087029 | A | 5/1982 | |
| JP | 11230662 | A * | 8/1999 | |
| JP | 2000018796 | | 1/2000 | |
| JP | 2004053055 | | 2/2004 | |
| JP | 2004317024 | A * | 11/2004 | F25D 21/14 |
| JP | 2005027768 | | 2/2005 | |
| JP | 2006017338 | | 1/2006 | |
| JP | 2006017338 | A * | 1/2006 | |
| JP | 2006187449 | | 7/2006 | |
| JP | 201319623 | | 1/2013 | |
| JP | 2013085687 | | 5/2013 | |
| KR | 20100031929 | A | 3/2010 | |
| NL | 7801958 | A | 8/1979 | |
| WO | 8602149 | | 4/1986 | |
| WO | 2004106737 | | 5/2004 | |
| WO | 2005001357 | A1 | 1/2005 | |
| WO | 2005032322 | A2 | 4/2005 | |
| WO | WO-2006137422 | A1 * | 12/2006 | F25D 23/003 |
| WO | 2007013327 | A1 | 2/2007 | |
| WO | 2007093461 | A1 | 8/2007 | |
| WO | 2008077708 | A1 | 7/2008 | |
| WO | 2008110451 | A1 | 9/2008 | |
| WO | 2008151938 | | 12/2008 | |
| WO | 2009031812 | A2 | 3/2009 | |
| WO | 2009059874 | A1 | 5/2009 | |
| WO | 2009077226 | | 6/2009 | |
| WO | 2009077227 | | 6/2009 | |
| WO | 2009077291 | A1 | 6/2009 | |
| WO | 2009089460 | | 7/2009 | |
| WO | 2010028992 | A1 | 3/2010 | |
| WO | 2010040635 | | 4/2010 | |
| WO | 2010071355 | A2 | 6/2010 | |
| WO | 2010102892 | A1 | 9/2010 | |
| WO | 2010112321 | A1 | 10/2010 | |
| WO | 2010118939 | A1 | 10/2010 | |
| WO | 2011057954 | A2 | 5/2011 | |
| WO | 2011061068 | A1 | 5/2011 | |
| WO | 2012022803 | A1 | 2/2012 | |

(56) References Cited

FOREIGN PATENT DOCUMENTS

| | | | |
|---|---|---|---|
| WO | 2012065916 | A1 | 5/2012 |
| WO | 2012093059 | A1 | 7/2012 |
| WO | 2012101028 | A1 | 8/2012 |
| WO | 2012134149 | A2 | 10/2012 |
| WO | 2012138136 | A2 | 10/2012 |
| WO | 2013129779 | A1 | 9/2013 |
| WO | 2013144763 | A2 | 10/2013 |
| WO | 2013144764 | A1 | 10/2013 |
| WO | 2014001950 | A1 | 1/2014 |
| WO | 2014040923 | A1 | 3/2014 |
| WO | 2014041097 | A1 | 3/2014 |
| WO | 2014076149 | A1 | 5/2014 |
| WO | 2014095790 | A1 | 6/2014 |
| WO | 2014102073 | A1 | 7/2014 |
| WO | 2014102144 | A1 | 7/2014 |
| WO | 2014102317 | A2 | 7/2014 |
| WO | 2014102322 | A1 | 7/2014 |
| WO | 2014154278 | A1 | 10/2014 |
| WO | 2015003742 | A1 | 1/2015 |
| WO | 2015028270 | A1 | 3/2015 |
| WO | 2015074837 | A1 | 5/2015 |
| WO | 2015082011 | A1 | 6/2015 |
| WO | 2015101386 | A1 | 7/2015 |
| WO | 2015101387 | A1 | 7/2015 |
| WO | 2015101388 | A1 | 7/2015 |
| WO | 2015101892 | A1 | 7/2015 |
| WO | 2015160172 | A1 | 10/2015 |
| WO | 2016006900 | A1 | 1/2016 |
| WO | 2016020852 | A1 | 2/2016 |
| WO | 2016085432 | | 6/2016 |
| WO | 2016095970 | | 6/2016 |
| WO | 2016150660 | A1 | 9/2016 |

* cited by examiner

HEAT REJECTION SYSTEM FOR A CONDENSER OF A REFRIGERANT LOOP WITHIN AN APPLIANCE

FIELD OF THE DEVICE

The device is in the field of appliances that incorporate a refrigerant loop, and more specifically, a heat rejection system incorporated within a refrigerant loop for rejecting heat within a condenser and also cooling a compressor of the refrigerant loop.

SUMMARY

In at least one aspect, a refrigerator includes a cabinet defining a refrigerated compartment and a machine compartment. A compressor is disposed within the machine compartment and is adapted to compress a refrigerant within a refrigerant line. A micro-channel condenser is positioned in communication with the compressor and is adapted to selectively reject heat from the refrigerant into the machine compartment. A condenser fan is positioned within the machine compartment between the condenser and compressor. The fan is adapted to draw heated air through the condenser and also draw fresh air from an area adjacent the machine compartment and beneath the refrigerated compartment. The heated air and fresh air combine to define mixed air that is directed toward the compressor for cooling the compressor.

In at least another aspect, a heat rejection system for an appliance includes a cabinet defining a machine compartment disposed proximate a refrigerated compartment. A linear compressor is disposed within the machine compartment. The compressor is adapted to compress a refrigerant within a refrigerant line that is in thermal communication with the refrigerated compartment. A condenser of the refrigerant line is positioned at an angle with respect to an axis of the compressor. The condenser is in thermal communication with at least an exterior surface of the compressor. The condenser is adapted to reject heat from the refrigerant and deliver the heat to process air to define heated air. A condenser fan is positioned between the condenser and compressor. The fan is adapted to draw the heated air from the condenser and also draw fresh air from an area laterally adjacent to the machine compartment and under the refrigerated compartment. The heated air and fresh air combine to define mixed air that is directed toward the compressor for cooling the exterior surface of the compressor.

In at least another aspect, a heat rejection system for an appliance includes a linear compressor adapted to compress a refrigerant within a refrigerant line. A micro-channel condenser of the refrigerant line is positioned at a 45 degree angle with respect to a linear axis of the compressor. The condenser is in thermal communication with at least an exterior surface of the compressor. The condenser is adapted to reject heat from the refrigerant delivered through the condenser and deliver the heat to process air to define heated air. A condenser fan is positioned between the condenser and compressor and proximate a leading edge of the condenser. The fan is adapted to draw the heated air from the condenser and also draw fresh air from a fresh air vent positioned adjacent to a trailing edge of the condenser, wherein the heated air and fresh air combine at the fan to define mixed air that is directed toward the compressor for cooling the exterior surface of the compressor.

These and other features, advantages, and objects of the present device will be further understood and appreciated by those skilled in the art upon studying the following specification, claims, and appended drawings.

DETAILED DESCRIPTION OF EMBODIMENTS

Figure 1:
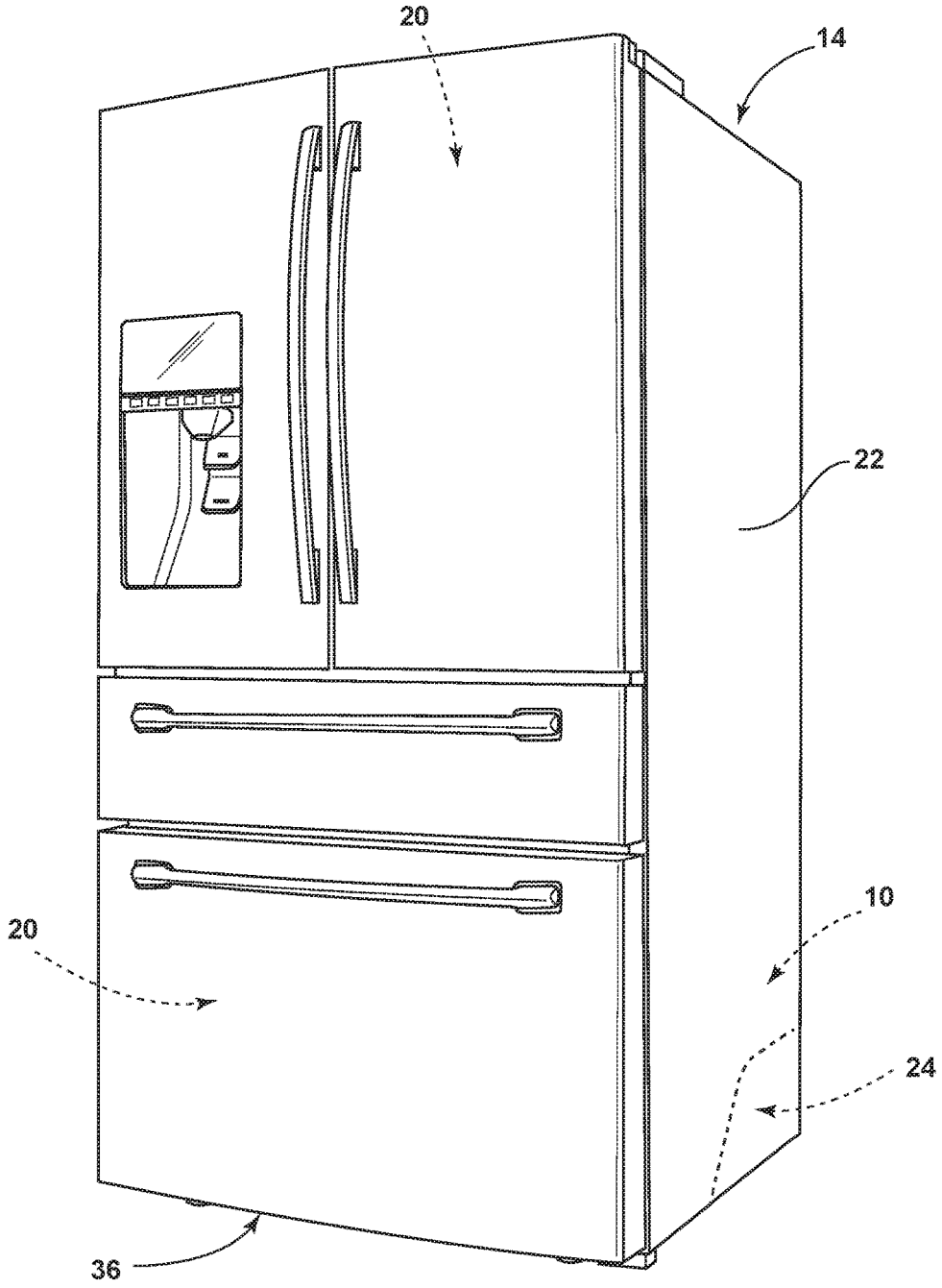
FIG. 1 is a front perspective view of an appliance that includes a refrigerant loop incorporating an aspect of the heat rejection system.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
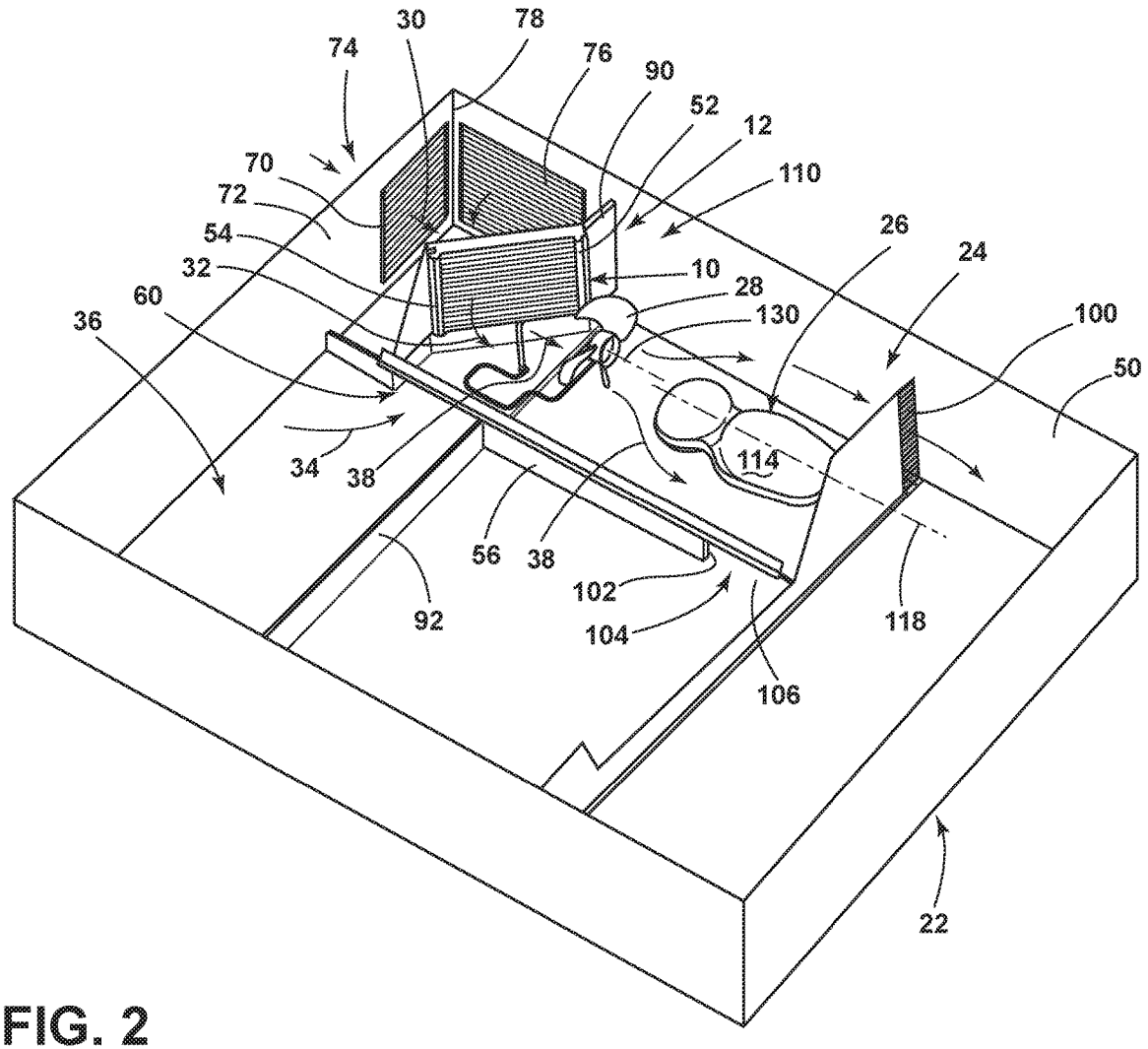
FIG. 2 is a top perspective view of a machine compartment for an appliance incorporating an aspect of the heat rejection system.
Figure 3:
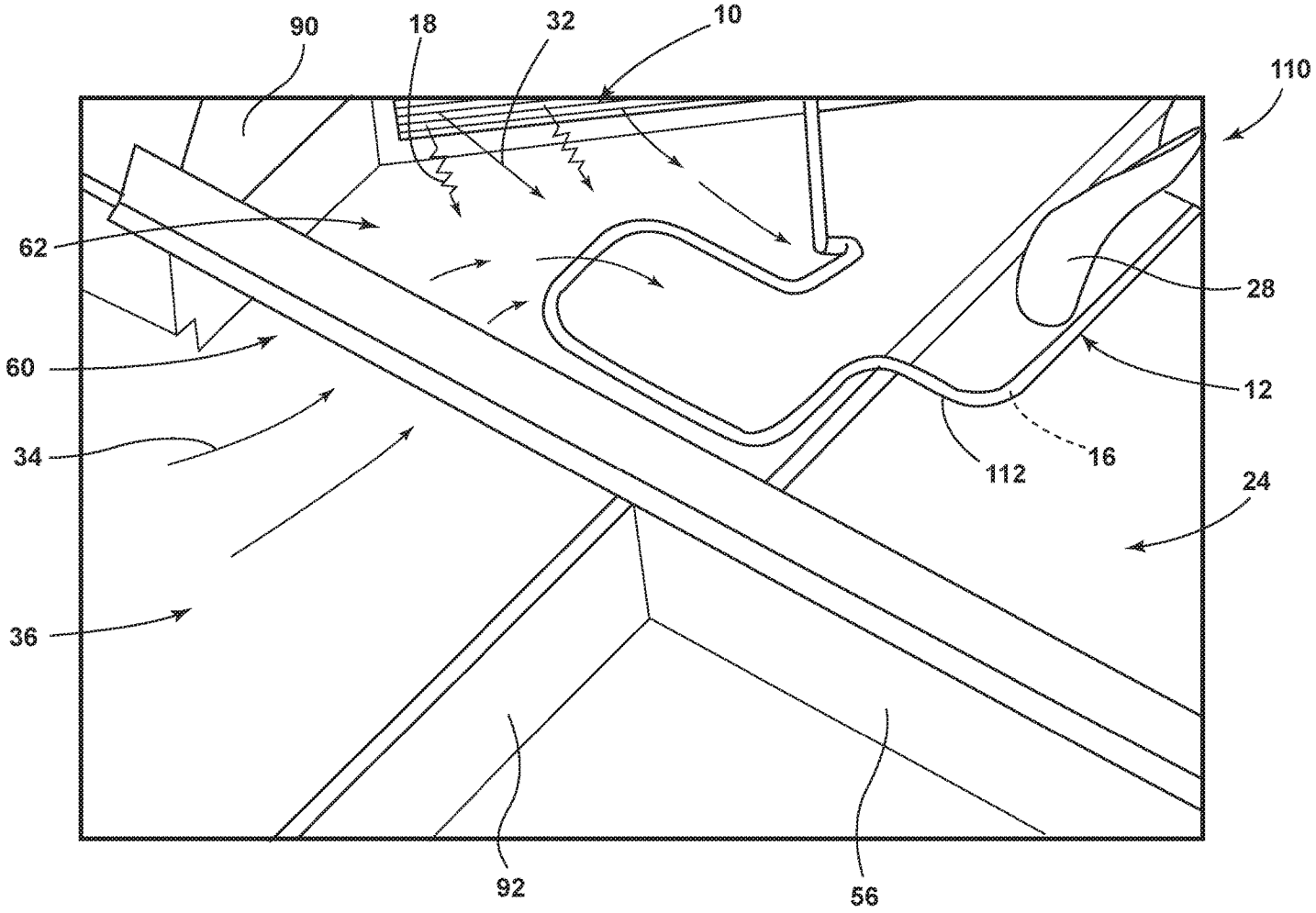
FIG. 3 is an enlarged perspective view of the machine compartment of FIG. 2.

As illustrated in FIGS. 1-3, reference numeral 10 generally refers to a condenser incorporated within a refrigerant loop 12 of an appliance 14. The refrigerant loop 12 includes a refrigerant 16 that defines a thermal transfer media for absorbing heat 18 within an evaporator (not shown) and rejecting heat 18 from a condenser 10 in order to cool one or more refrigerated compartments 20 of the appliance 14. According to the various embodiments, the refrigerating appliance 14 can include a cabinet 22 that defines at least one refrigerated compartment 20 and a machine compartment 24. A compressor 26 is disposed within the machine compartment 24.

Referring again to FIGS. 1-3, the compressor 26 is adapted to compress the refrigerant 16 into a vapor that is then delivered to the condenser 10 where the vaporized refrigerant 16 is condensed into a liquid. Through this change in state of refrigerant 16 from a vapor state to a liquid state, heat 18 is rejected from the refrigerant 16 while in the condenser 10. The refrigerant 16 in a liquid state is then moved toward an expansion device where the refrigerant 16 is transferred again into a combination liquid/vapor state to be delivered to the evaporator. Within the evaporator, the refrigerant 16 is transferred back into a vapor state. Through this transfer from a liquid/vapor state to a vapor state of the refrigerant 16, heat 18 is absorbed into the refrigerant 16 at the evaporator. In this manner, the area around the evaporator is cooled, such as within the refrigerated compartment 20. The now vaporized refrigerant 16 is transferred back to the compressor 26 to be re-pressurized for later condensation and rejection of the heat 18 that has been acquired within the evaporator.

As exemplified in FIGS. 1-3, in order to assist the transfer of heat 18 within the condenser 10 and evaporator, the refrigerant loop 12 can include one or more fans 28, including a condenser fan 28. A fan 28 proximate the evaporator assists in the absorption of heat 18 into the refrigerant 16 within the evaporator as air is passed across the surface of the evaporator. Similarly, the rejection of heat 18 from the refrigerant 16 within the condenser 10 is assisted through operation of the condenser fan 28 that passes process air 30 across and/or through portions of the condenser 10 to aid in the rejection of heat 18 from the refrigerant 16.

Referring again to FIGS. 1-3, the condenser 10, typically in the form of a micro-channel condenser 10, can be positioned in communication with the compressor 26. In this manner, the micro-channel condenser 10 can be adapted to selectively reject heat 18 from the refrigerant 16 into the machine compartment 24 and, typically, out of the appliance 14 altogether. The condenser fan 28 is positioned within the machine compartment 24 proximate the condenser 10. It is contemplated that the condenser fan 28 is positioned between the condenser 10 and the compressor 26 such that the fan 28 is adapted to draw heated air 32 through and/or from the condenser 10. The condenser fan 28 is also adapted to draw fresh air 34 from an area, such as a vent space 36, adjacent to the machine compartment 24. This fresh air 34 can be drawn from an area beneath the refrigerated compartment 20. It is contemplated that heated air 32 and fresh air 34 combine to define mixed air 38 that is directed toward the compressor 26 for cooling the compressor 26 during operation of the condenser fan 28. It is contemplated that this configuration of the condenser fan 28 between the micro-channel condenser 10 and the compressor 26 allows for a greater rejection of heat 18 from the condenser 10 and also greater cooling capacity provided to an area proximate the compressor 26.

Referring again to FIGS. 1-3, it is contemplated that the condenser 10 is positioned at an angle with respect to a rear wall 50 of the machine compartment 24. In this configuration, a leading edge 52 of the condenser 10 engages the rear wall 50 and extends at a 45° angle away from the compressor 26. Stated another way, a trailing edge 54 of the condenser 10 is positioned proximate a front wall 56 of the machine compartment 24 and is positioned at a 45° angle distal from the compressor 26. In this configuration, the leading edge 52 of the condenser 10 proximate the rear wall 50 is positioned closer to the compressor 26 than the trailing edge 54 of the condenser 10.

Referring again to FIGS. 1-3, it is contemplated that the machine compartment 24 includes the front wall 56, where the front wall 56 defines a fresh air duct 60 for delivering the fresh air 34 to be mixed with the heated air 32. The angled configuration of the condenser 10 provides a clear space 62 proximate an area of the front wall 56 of the machine compartment 24 to include the fresh air duct 60 within the front wall 56. This fresh air duct 60 allows for the movement of fresh air 34 from the vent space 36 positioned adjacent to the machine compartment 24 and below the refrigerated compartment 20 of the appliance 14.

During operation of the condenser fan 28, the condenser fan 28 draws heated air 32 from the condenser 10 and also draws fresh air 34 from this vent space 36 through the fresh air duct 60. The fresh air 34 and heated air 32 are combined proximate the condenser fan 28 to define mixed air 38 that is delivered to the compressor 26. This mixed air 38 that is cooled through the incorporation of the fresh air 34 from the vent space 36 tends to have a greater cooling capacity for absorbing heat 18 from the compressor 26. This absorption of heat 18 from the compressor 26 allows for greater cooling of the compressor 26 and a more efficient refrigeration system.

Referring again to FIGS. 1-3, to provide greater air flow into the machine compartment 24, the machine compartment 24 can include a side vent 70 positioned within a first side wall 72 of the cabinet 22 adjacent to the condenser 10. It is contemplated that process air 30 is delivered at least from an external area 74 and into the machine compartment 24 and toward the condenser 10 via the side vent 70. This process air 30 is drawn into the condenser 10 through operation of the condenser fan 28. Additionally, the rear wall 50 of the machine compartment 24 includes a rear vent 76 that extends from an edge 78 of the rear wall 50 proximate the first side wall 72 to an area proximate the leading edge 52 of the condenser 10. Again, the angled configuration of the condenser 10, in particular the 45° angle, provides for an enlarged rear vent 76 that increases the amount of process air 30 that can be delivered through the condenser 10 during operation of the condenser fan 28.

Referring again to FIGS. 1-3, to direct the flow of process air 30 from the side vent 70 and rear vent 76 through the condenser 10, it is contemplated that the condenser 10 can be disposed within a condenser wall 90 that extends between the front wall 56 and rear wall 50 of the machine compartment 24. The condenser wall 90 helps to direct the process air 30 through the condenser 10 by preventing the process air 30 from leaking around the condenser 10. It is also contemplated that this condenser wall 90 can at least partially define the fresh air duct 60 within the front wall 56 of the machine compartment 24. In such an embodiment, the condenser wall 90, proximate the trailing edge 54 of the condenser 10, can define a boundary of the fresh air duct 60 such that the size of the fresh air duct 60 can extend from the condenser wall 90 at least to an interior support wall 92 defined proximate the vent space 36 of the appliance 14.

In order to allow for the efficient flow of process air 30, heated air 32, fresh air 34 and mixed air 38 through the machine compartment 24, various air exhaust vents 100 are also included within the machine compartment 24. The machine compartment 24, in order to operate in a quiet manner, includes various sound insulation members 102 that are disposed proximate the front wall 56 of the machine compartment 24. These sound insulation members 102 serve to dampen noise generated by the compressor 26, condenser fan 28 and other motorized components of the appliance 14. It is contemplated that this sound insulation member 102 can define a gap 104 proximate the compressor 26 that characterizes a front air exhaust 106 of the machine compartment 24. This front air exhaust 106, along with the other air exhaust vents 100 of the machine compartment 24, allow for the efficient flow of mixed air 38 out of the machine compartment 24 such that heat 18 from the compressor 26 can be absorbed by the mixed air 38 and moved away from the compressor 26 and out of the appliance 14.

Referring now to FIGS. 1-3, 5, 7, 9, 11, 13 and 15, the heat rejection system 110 for the appliance 14 includes a cabinet 22 that defines the machine compartment 24 disposed proximate the refrigerated compartment 20. The linear compressor 26 is disposed within the machine compartment 24 and is adapted to compress the refrigerant 16 within the refrigerant line 112 into a compressed vapor. The refrigerant line 112 is in thermal communication with the refrigerated compartment 20, via the evaporator, to allow for the absorption of heat 18 from the refrigerated compartment 20 through operation of the evaporator of the refrigerant line 112. The condenser 10 of the refrigerant line 112 is positioned at an angle with respect to a linear axis 118 of the compressor 26. It is contemplated that the condenser 10 is placed in thermal communication with at least an exterior surface 114 of the compressor 26. The condenser 10 is adapted to reject heat 18 from the refrigerant 16 passing through the condenser 10. This heat 18 is rejected from the condenser 10 and delivered into the process air 30 moving through the condenser 10 to define heated air 32 that exits a rear surface 116 of the condenser 10.

Referring again to FIGS. 1-3, 5, 7, 9, 11, 13 and 15, the condenser fan 28 is positioned between the condenser 10 and a compressor 26. The condenser fan 28 is adapted to draw the heated air 32 from the condenser 10 and also draw fresh air 34 from the vent space 36 laterally adjacent to the machine compartment 24 and under the refrigerated compartment 20. The heated air 32 and fresh air 34 are combined to define mixed air 38 that is directed toward the compressor 26 for cooling the exterior surface 114 of the compressor 26. It is contemplated that the condenser fan 28 is positioned to define a rotational axis 130 that is positioned substantially parallel with an axis of the linear compressor 26. Accordingly, the condenser 10 is positioned at a 45° angle with respect to the front and rear walls 56, 50 of the machine compartment 24 and also with respect to the rotational axis 130 of the condenser fan 28 and the linear axis 118 of the linear compressor 26. The positioning of these components of the heat rejection system 110 provides for the efficient rejection of heat 18 from the condenser 10 and, simultaneously, the efficient absorption of heat 18 from the exterior surface 114 of the compressor 26 to prevent overheating of the compressor 26 during operation of the appliance 14.

Figure 4:
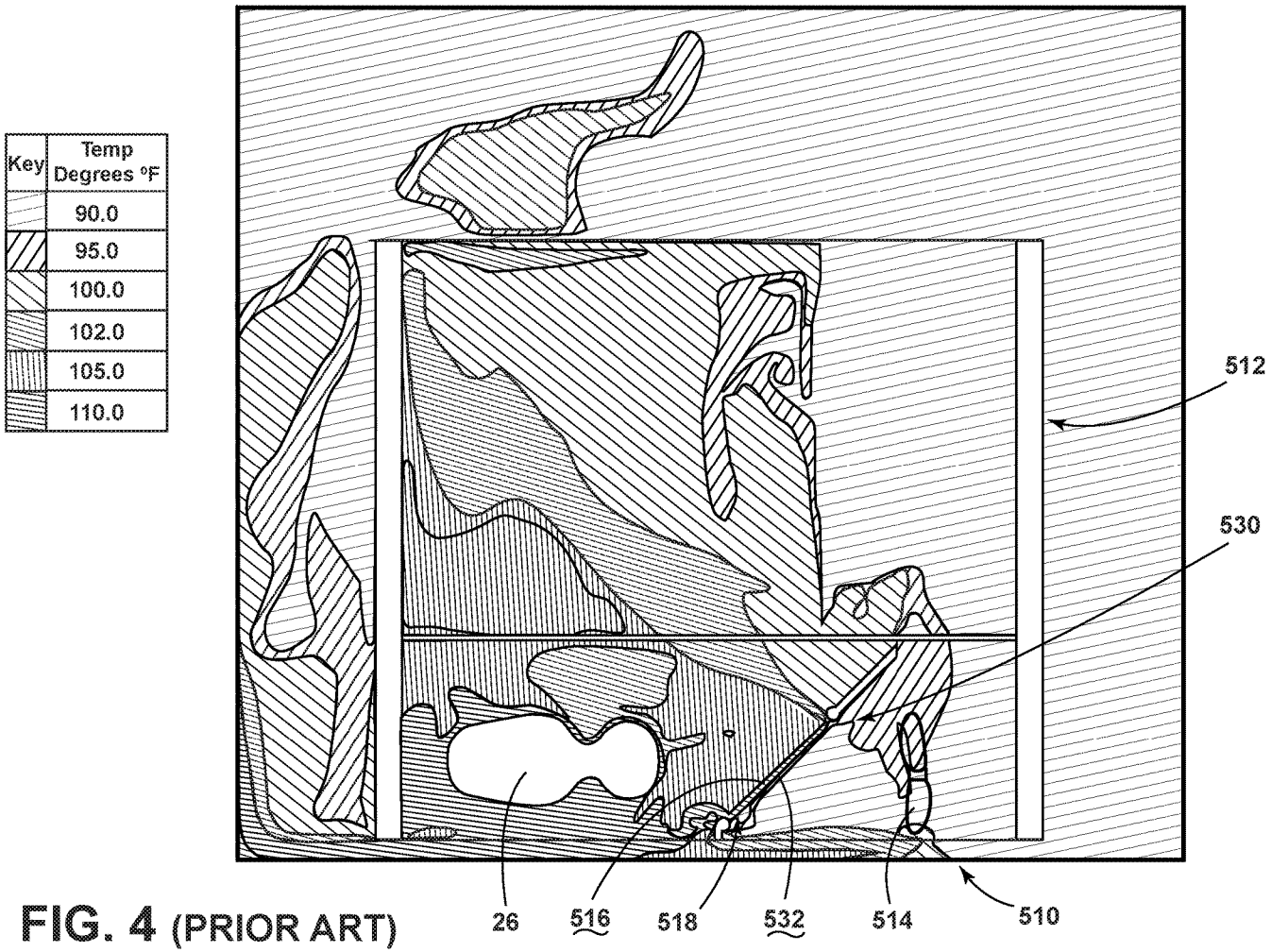
FIG. 4 (PRIOR ART)
FIG. 4 is a schematic top plan view of a prior art machine compartment illustrating temperatures of the prior art machine compartment during operation of the appliance.
Figure 6:
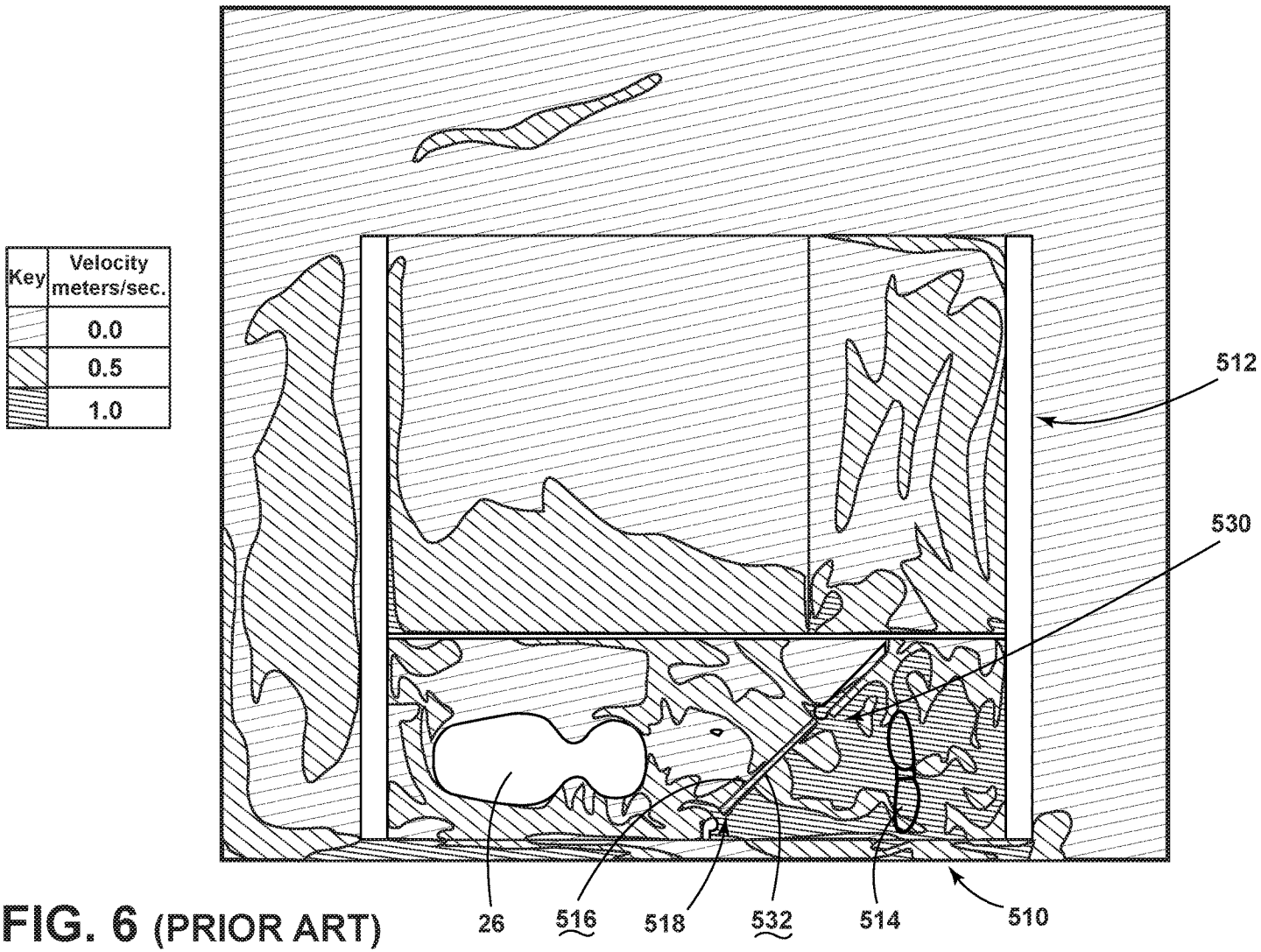
FIG. 6 (PRIOR ART)
FIG. 6 is a top plan view of the prior art machine compartment of FIG. 4 illustrating air velocity within the machine compartment during operation of the prior art appliance.

Referring now to the prior art machine compartment 510 exemplified in FIGS. 4 and 6, typical prior art appliances 512 include a blower 514 that is positioned proximate a back side 516 of the prior art condenser 518 such that the prior art condenser 518 is positioned between the compressor 26 and the blower 514. In this configuration, the blower 514 pushes process air 30 into the prior art condenser 518 for collecting the rejected heat 18 from the prior art condenser 518 and moving the air through the prior art machine compartment 510. As exemplified in the temperature plot of FIG. 4, heated air 32 from the prior art condenser 518 is pushed away from the prior art condenser 518 and towards the compressor 26. The heated air 32 is also pushed into areas under the refrigerated compartment 20 of the prior art appliance 512.

Similarly, the prior art velocity plot of FIG. 6 shows that the process air 30 having the highest velocity is contained within an area upstream of the prior art condenser 518 and proximate the back side 516 of the prior art condenser 518. Air leaving the prior art condenser 518 and moving toward the compressor 26 has a much lesser velocity. The higher velocity of air proximate the back side 516 of the condenser 10 indicates that the positioning of the blower 514 in this configuration merely pushes this process air 30 around and within this area upstream of the prior art condenser 518 within the prior art machine compartment 510. Only a portion of this air pushed by the blower 514 is moved through the prior art condenser 518 and to other portions of the prior art machine compartment 510.

Additionally, the velocity plot of FIG. 6 of the prior art appliance 512 shows that air that does move through the prior art condenser 518 is directly only partially toward the compressor 26. A significant portion of this air is pushed toward an area adjacent to the prior art machine compartment 510 under the refrigerated compartment 20. Significantly, the temperature plot of FIG. 4 and the velocity plot of FIG. 6 show that the compressor 26 is surrounded by a significant portion of high temperature air in excess of 110° F. This air is also moving at a very low speed of less than approximately 0.5 meters per second. This slow movement of heated air 32 minimizes the ability of this air to collect heat 18 from the compressor 26 and move this heat 18 away from the prior art appliance 512.

Figure 5:
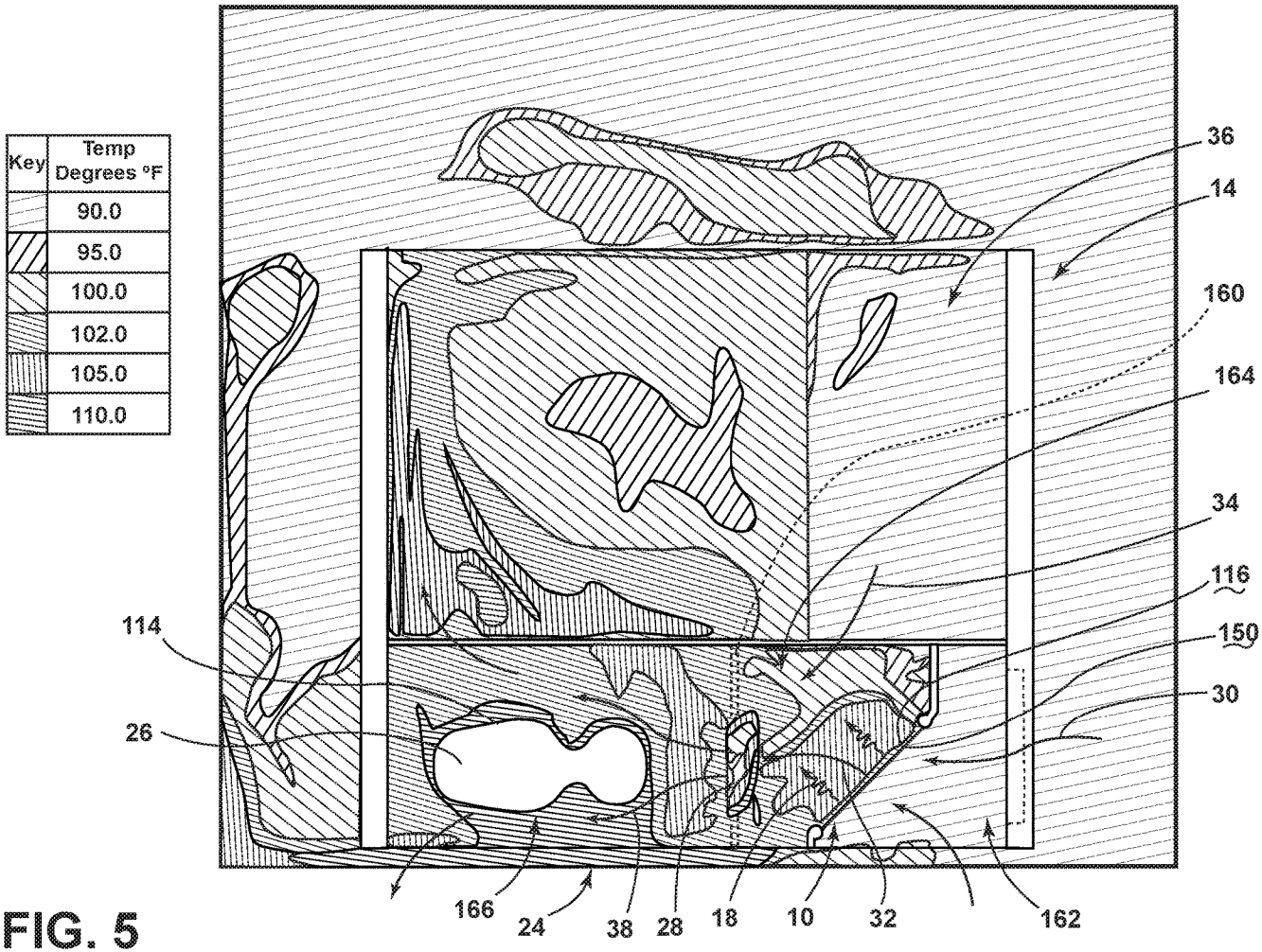
FIG. 5 is a top plan view of the machine compartment of FIG. 2 illustrating temperatures within the machine compartment during operation of the the heat rejection system.
Figure 7:
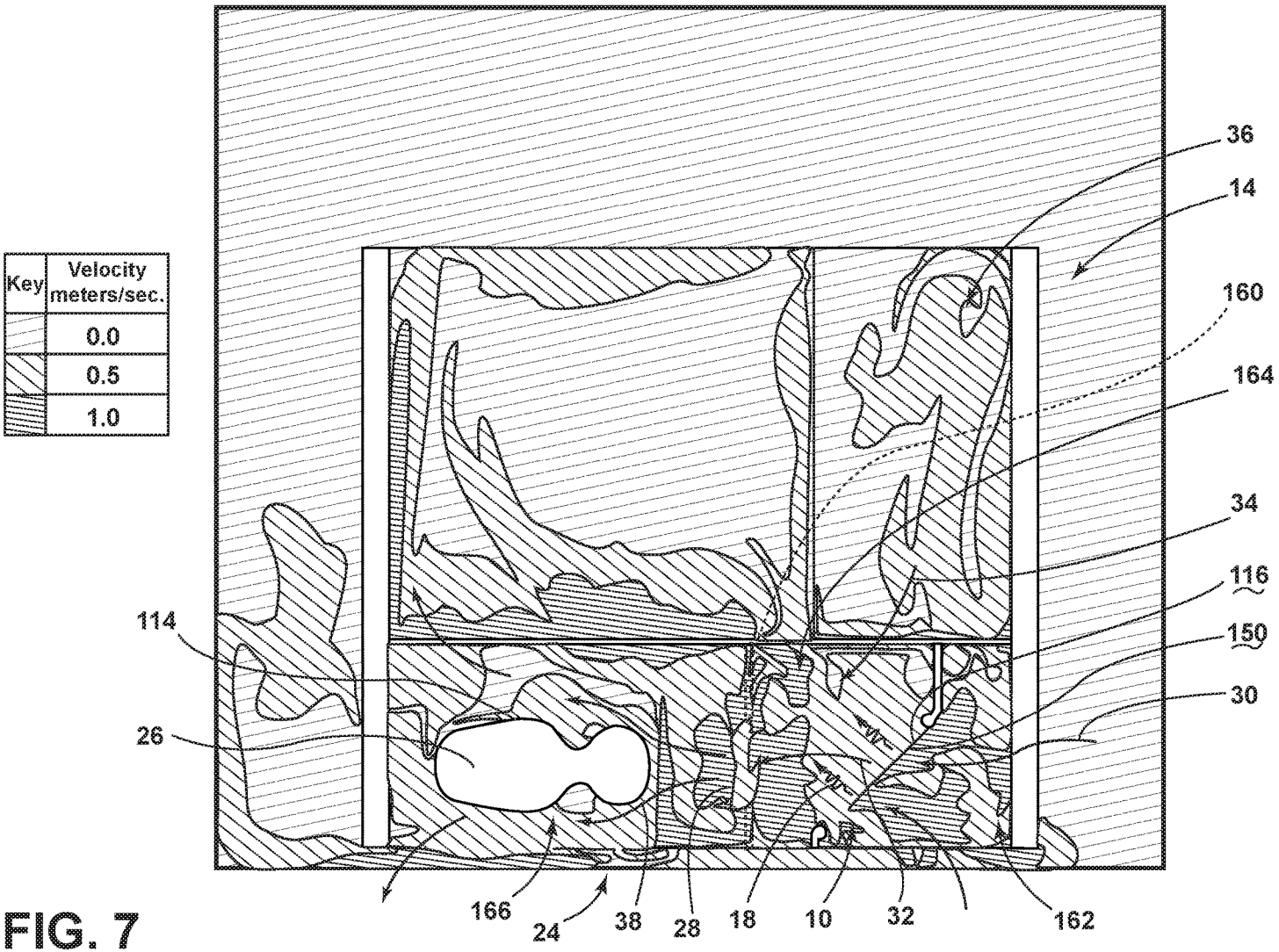
FIG. 7 is a top plan view of the machine compartment of FIG. 5 illustrating air velocity during operation of the heat rejection system.

Referring now to FIGS. 5 and 7 illustrating a temperature plot and velocity plot, respectively, of an appliance 14 incorporating the disclosed heat rejection system 110, the condenser fan 28 is positioned to pull heated air 32 from the rear surface 116 of the condenser 10. By pulling air from the rear surface 116 of the condenser 10, the velocity of heated air 32 leaving the condenser 10 is increased to be at minimum of approximately 0.5 meters per second. This heated air 32 is then mixed with the fresh air 34 to form the mixed air 38 that is directed through the condenser fan 28 and toward the compressor 26. Additionally, as exemplified in FIG. 5, the area of highest temperature air of at least 110° F. is limited to the area immediately surrounding the compressor 26. Accordingly, the air surrounding the compressor 26 has a generally lower temperature and a greater capacity for drawing heat 18 from the compressor 26 to be removed from the appliance 14.

Additionally, the configurations of the heat rejection system 110 exemplified in FIGS. 5 and 7 illustrate the in-flow of fresh air 34 from the vent space 36. By mixing this fresh air 34 with the heated air 32, the thermal capacity of the process air 30 moving through the condenser 10 to absorb the rejected heat 18 is increased. Stated another way, the fresh air 34 serves to lower the temperature of the heated air 32 leaving the condenser 10 such that greater amounts of heat 18 can be transferred into the process air 30 to form heated air 32 that is moved toward the condenser fan 28 and ultimately the compressor 26. The addition of the fresh air duct 60 also allows air from the vent space 36 to be moved into the machine compartment 24.

This is in direct contrast to the prior art design exemplified in FIGS. 4 and 6, that clearly shows an increased velocity of heated air 32 moving away from the prior art machine compartment 510 into the space beneath the refrigerated compartment 20. This prior art configuration can have a tendency to cause an increase in temperature within the refrigerated compartment 20 that must be accommodated by the prior art refrigeration loop 530 and the compressor 26 working harder to overcome this infusion of heated air 32 beneath the refrigerated compartment 20.

Referring again to FIGS. 5 and 7, the placement of the condenser fan 28 and the angled configuration of the condenser 10 allows for inclusion of the fresh air duct 60 and an increased size of the rear vent 76. This configuration increases the capacity of the process air 30 and fresh air 34 to receive the rejected heat 18 from the condenser 10 and also increases the capacity of the mixed air 38 to absorb heat 18 from the compressor 26 to better cool the compressor 26 during operation of the appliance 14.

Figure 9:
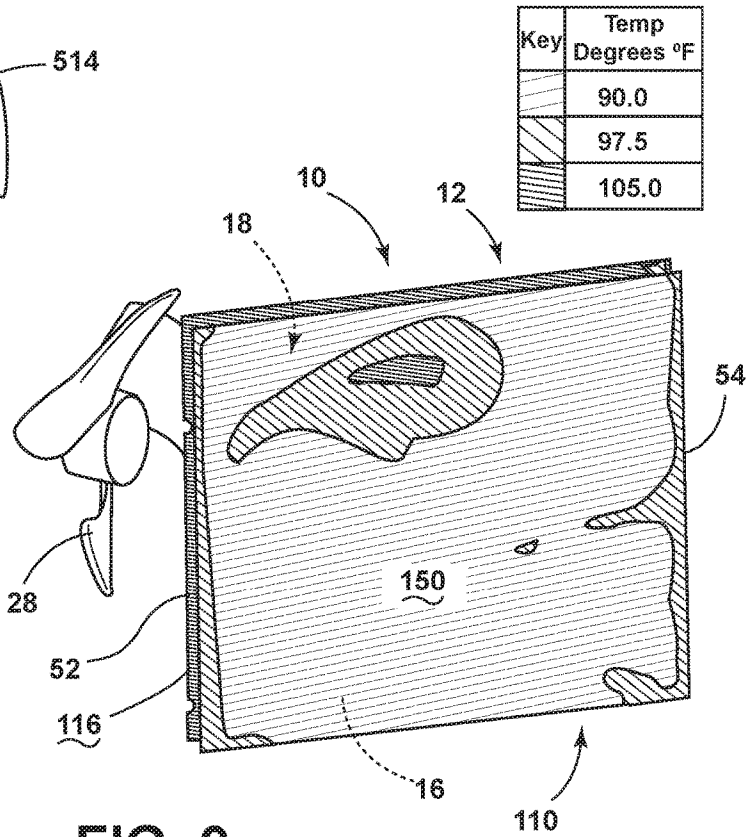
FIG. 9 is a schematic perspective view of the condenser of FIG. 2 illustrating surface temperatures of a front surface of the condenser during operation of the heat rejection system.
Figure 8:
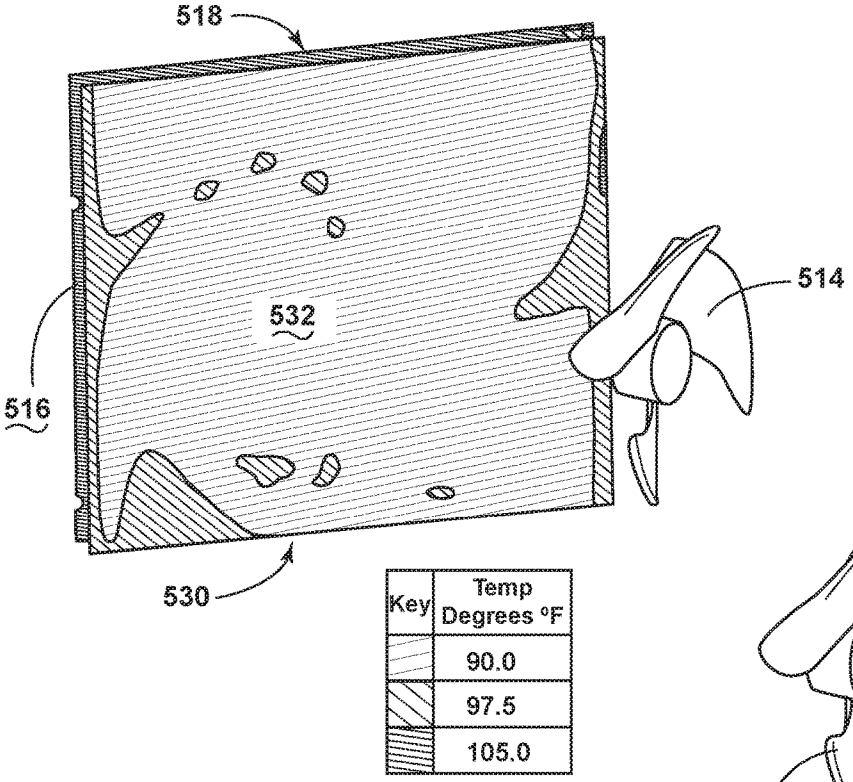
FIG. 8 (PRIOR ART)
FIG. 8 is a schematic perspective view of a front side of a prior art condenser illustrating temperatures on the front side of the condenser during operation of the prior art appliance.

Referring now to FIGS. 8 and 9 that exemplify a side-to-side comparison of the front surface 150 of the prior art condenser 518 (FIG. 8) and the condenser 10 included within the heat rejection system 110 (FIG. 9). The prior art condenser 518 shows a substantially consistent low temperature level along the front side 532 of the prior art condenser 518. Also, the prior art design pushes the process air 30 against the front side 532 of the prior art condenser 518 but little of this air is passed through the prior art condenser 518. Conversely, the condenser 10 of the heat rejection system 110 disclosed herein shows an increased temperature that is indicative of greater heat rejection from the condenser 10 into the process air 30 that is moved through the condenser 10. By drawing the air through the condenser 10 through the downstream placement of the condenser fan 28, the heat rejection system 110 disclosed herein provides for a greater movement of air through the front surface 150 of the condenser 10 and a greater heat rejection rate within the condenser 10 of the heat rejection system 110.

Figure 10:
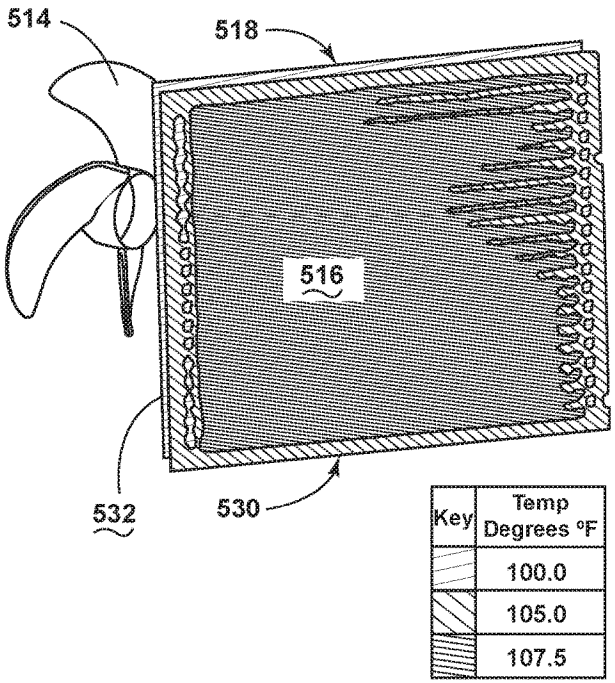
FIG. 10 (PRIOR ART)
FIG. 10 is a rear perspective view of the condenser of a prior art appliance illustrating temperatures on the back side of the prior art condenser during operation of the prior art appliance.
Figure 11:
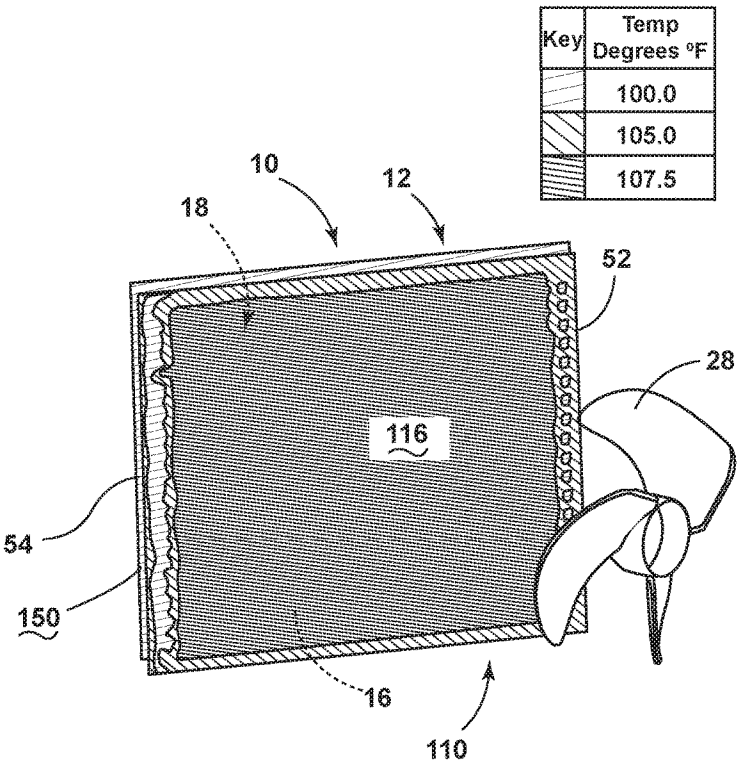
FIG. 11 is a schematic rear perspective view of the condenser of FIG. 2 illustrating surface temperatures of the back surface of the condenser during operation of the heat rejection system.

Referring now to FIGS. 10 and 11, these figures illustrate a side-by-side comparison of the temperature of the back side 516 of the prior art condenser 518 (FIG. 10) and the rear surface 116 of the condenser 10 of the heat rejection system 110 (FIG. 11). The prior art condenser 518 shows areas of decreased temperature along the back side 516 that is indicative of lesser heat rejection during operation of the prior art condenser 518. As discussed above, the placement of the blower 514 of the prior art design results in lesser air moving through the prior art condenser 518 and, in turn, less efficient heat rejection of the prior art condenser 518. Conversely, the heat rejection system 110 exemplified in FIG. 11 shows a more consistent and high temperature level of the rear surface 116 of the condenser 10. This consistent temperature is indicative of a more efficient rejection of heat 18 as the process air 30 moves through the condenser 10 to define the heated air 32 that is drawn from the rear surface 116 of the condenser 10 by the condenser fan 28.

Figures 12, 13:
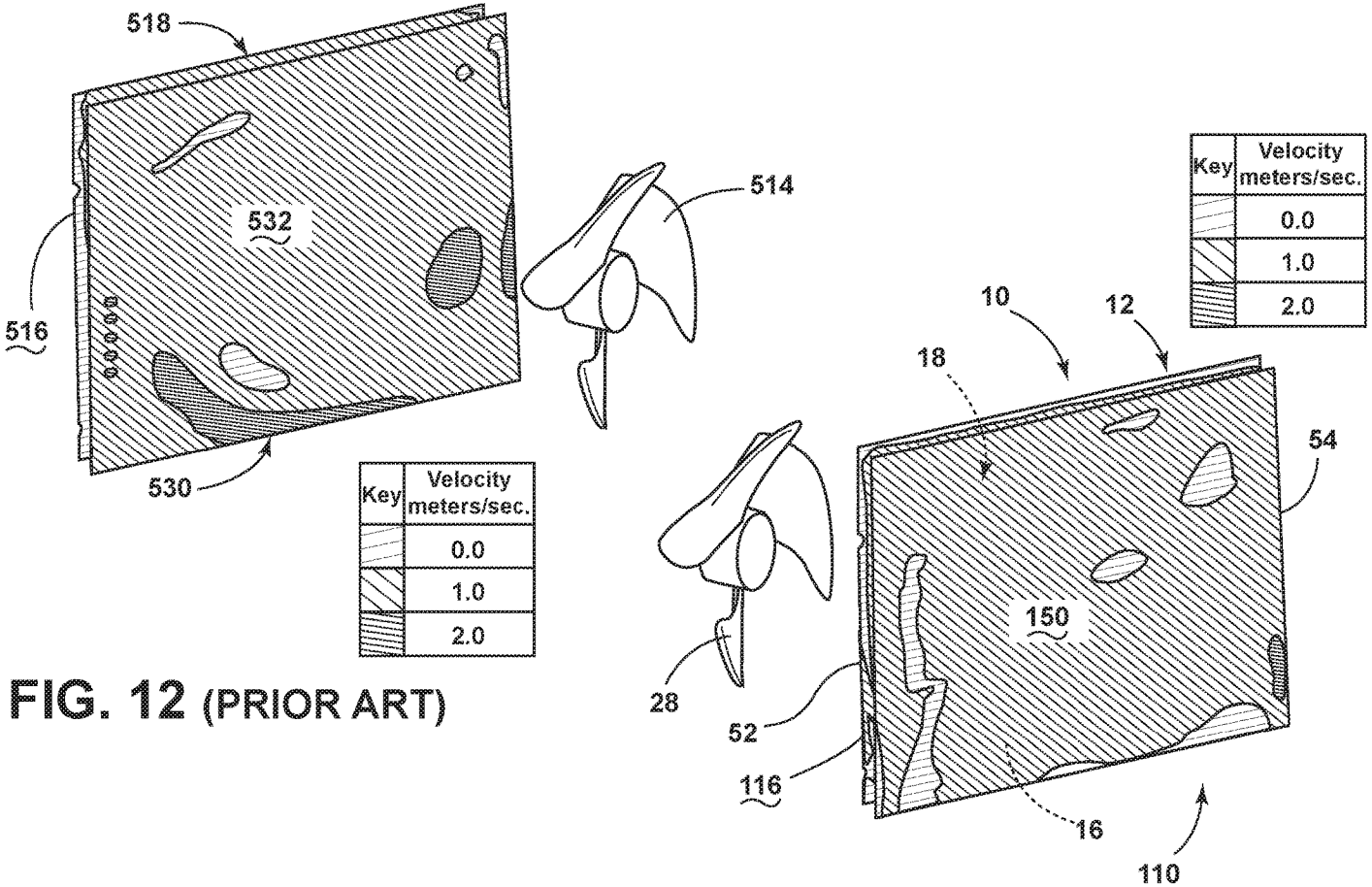
FIG. 12 (PRIOR ART)
FIG. 12 is a front perspective view of a prior art condenser illustrating velocity of air entering the prior art condenser.
FIG. 13 is a schematic front perspective view of the condenser of FIG. 9 illustrating the velocity of air entering the condenser during operation of the heat rejection system.
Figure 14:
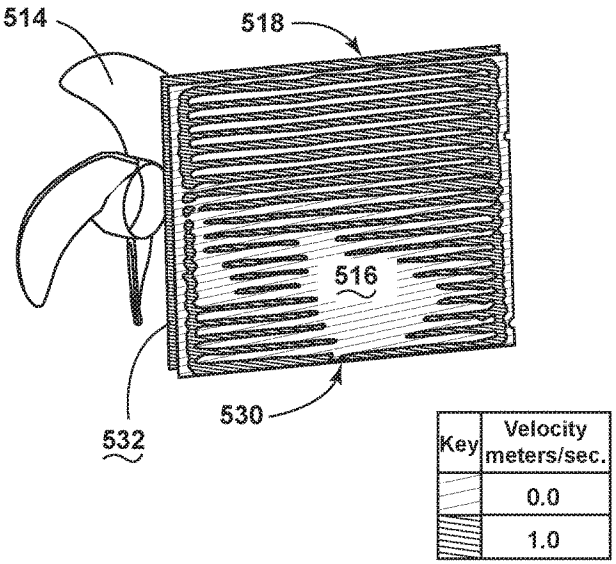
FIG. 14 (PRIOR ART)
FIG. 14 is a schematic rear perspective view of a prior art condenser illustrating a velocity of air leaving the condenser during operation of the prior art appliance.
Figure 15:
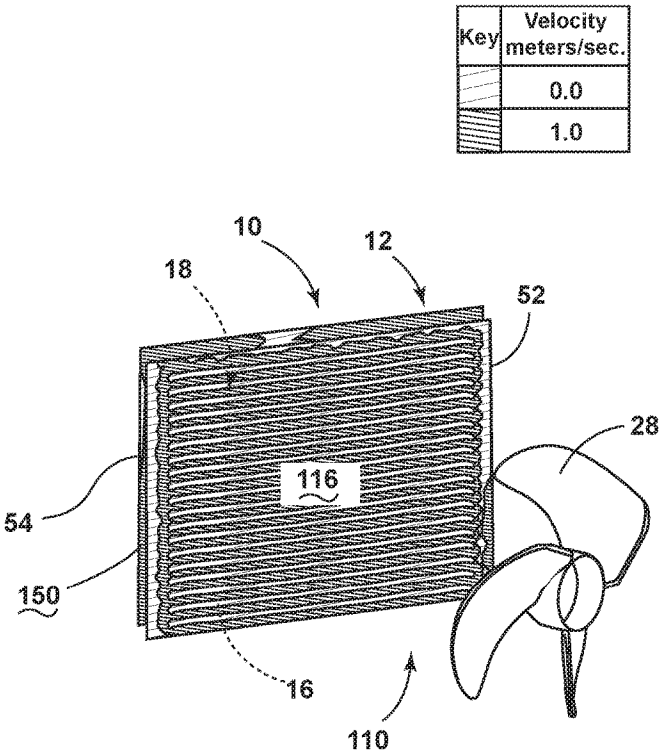
FIG. 15 is a schematic rear perspective view of the condenser of FIG. 11 illustrating the velocity of air leaving the condenser during operation of the heat rejection system.

Referring now to FIGS. 12-15, these figures illustrate side-by-side comparisons of the air velocities moving through the prior art condenser 518 (FIGS. 12 and 14) and the condenser design of the heat rejection system 110 disclosed herein (FIGS. 13 and 15). The prior art design of FIGS. 12 and 14 clearly show large areas of lower velocity air exiting the back side 516 of the prior art condenser 518 exemplified in FIG. 14. Also, FIG. 12 illustrates the prior art design and the inconsistent air velocity moving through the prior art condenser 518. This inconsistent air flow can produce an inefficient rejection of heat 18 from the prior art condenser 518. Conversely, the heat rejection system 110 disclosed herein, and exemplified in FIGS. 13 and 15 provides for a more consistent velocity of air moving through the condenser 10. FIG. 13 shows a more consistent velocity of air along the front surface 150 of the condenser 10 of the heat rejection system 110. As discussed above, this more consistent velocity of air along the entire front surface 150 of the condenser 10 provides for a more efficient rejection of heat 18 as this process air 30 moves through the condenser 10. Similarly, the back surface of the condenser 10 of the heat rejection system 110 shows a consistent velocity of air along the condenser 10 that is indicative of a consistent heat rejection along the entire back surface of the condenser 10 of the heat rejection system 110.

Referring again to FIGS. 1-3, 5, 7, 9, 11, 13 and 15, the heat rejection system 110 disclosed herein provides for an increased air flow rate within a machine compartment 24 of approximately 2.4 cubic feet of air per minute. This is approximately an 8 percent increase in air flow over the prior art design. Additionally, the placement of the fan 28 downstream of the condenser 10 allows for the inclusion of the fresh air duct 60 within the front wall 56 of the machine compartment 24. This flow of fresh air 34 through the fresh air duct 60 has been found to be approximately 3 cubic feet of air per minute which is added to the heated air 32 from the condenser 10 to define the mixed air 38.

Additionally, the use of the heat rejection system 110 disclosed herein allows for a heat transfer increase of approximately 3 percent. Additionally, heat transfer over the compressor 26 through use of the heat rejection system 110 disclosed herein was approximately 84 percent over that of the prior art design. Because the condenser fan 28 of the heat rejection system 110 is positioned closer to the compressor 26, the condenser fan 28 creates higher velocities of mixed air 38 that help to increase the transfer of heat 18 from the exterior surface 114 of the compressor 26 and into the mixed air 38. As is noted within the prior art design, air is moved away from the prior art machine compartment 510 and into areas proximate the refrigerated compartment 20 of the prior art appliance 512.

Referring again to FIGS. 1-3, 5, 7, 9, 11, 13 and 15, the angled configuration of the condenser 10 within the heat rejection system 110 provides for the placement of the fresh air duct 60 and also an increased size of the rear vent 76 to increase the inflow of process air 30 and fresh air 34 to aid in the transfer of thermal energy. This increased transfer of thermal energy allows for an increased rejection of heat 18 from within the condenser 10 and also an increased cooling of the exterior surface 114 of the compressor 26. Accordingly, the heat rejection system 110 disclosed herein can include the linear compressor 26 that is adapted to compress the refrigerant 16 within the refrigerant line 112. The microchannel condenser 10 of the refrigerant line 112 is positioned at a 45° angle with respect to a linear axis 118 of the compressor 26. The condenser 10 is in thermal communication with at least an exterior surface 114 of the compressor 26.

It is contemplated that the condenser 10 is also adapted to reject heat 18 from the refrigerant 16 delivered through the condenser 10 and, in turn, deliver the rejected heat 18 into the process air 30 to define heated air 32 that is drawn away from the rear surface 116 of the condenser 10. The condenser fan 28 is positioned between the condenser 10 and the compressor 26 and proximate a leading edge 52 of the condenser 10. The fan 28 is adapted to draw the heated air 32 from the condenser 10 and also draw fresh air 34 from the fresh air duct 60 positioned adjacent to a trailing edge 54 of the condenser 10. The heated air 32 and fresh air 34 combine at the fan 28 to define mixed air 38 that is directed towards the compressor 26 for cooling the exterior surface 114 of the compressor 26. The fresh air duct 60 draws fresh air 34 from the vent space 36 disposed under a refrigerated compartment 20 or other interior compartment of the appliance 14. The fresh air duct 60 is defined by the front wall 56 of the machine compartment 24. As discussed previously, the machine compartment 24 can include the condenser wall 90 that extends from a rear wall 50 of the machine compartment 24 and extends to a front wall 56 of the machine compartment 24. The condenser 10 is positioned within the condenser wall 90 such that the trailing edge 54 of the compressor 26 is positioned at a 45° angle away from the condenser 10. The fan 28 is positioned to define a rotational axis 130 that is substantially parallel with the linear axis 118 of the linear compressor 26. In this manner, rotational axis 130 of the fan 28 is also positioned at a 45° angle with respect to the condenser 10.

Referring again to FIGS. 2 and 3, the machine compartment 24 can also include a fan wall 160 that extends between the front and rear walls 56, 50 of the machine compartment 24. The fan wall 160 serves to direct the mixed air 38 into the condenser fan 28, which is set within the fan wall 160. In this manner, the condenser wall 90 and the fan wall 160 operate to segregate the machine compartment 24 into a plurality of spaces. The condenser wall 90 separates an upstream space 162, which receives the process air 30, from a mixing space 164. The upstream space 162 can include the side vent 70 and the rear vent 76. The mixing space 164 is defined between the condenser wall 90 and the fan wall 160. In the mixing space 164, the fresh air 34 is drawn through the fresh air duct 60 and is combined within the heated air 32 drawn from the condenser 10. This fresh air 34 and heated air 32 are combined in the mixing space 164 to define the mixed air 38 that is drawn through the fan wall 160 via the condenser fan 28. The mixed air 38 is blown by the condenser fan 28 into the compressor 26 space that houses the compressor 26. The compressor space 166 also includes the front air exhaust 106 and the other air exhaust vents 100 for delivering the mixed air 38 out of the machine compartment 24, after at least a portion of the mixed air 38 absorbs heat 18 from the exterior surface 114 of the compressor 26.

Through this configuration of the heat rejection system 110, the condenser fan 28 provides for an increased flow of heated air 32 from the condenser 10 that can be mixed with fresh air 34 from the vent space 36. The heated air 32 and fresh air 34 can be mixed within the mixing space 164 to define mixed air 38 that can be moved toward the compressor 26 within the compressor space 166 for cooling the compressor 26. The mixed air 38 typically has a lower temperature than the heated air 32 as a consequence of being mixed with the fresh air 34 from the fresh air duct 60. By decreasing the temperature of the mixed air 38, this mixed air 38 has a greater thermal capacity for absorbing heat 18 from the exterior surface 114 of the compressor 26. This system provides for greater movement of air and thermal exchange within the machine compartment 24 and also provides for a more efficient operation of the refrigeration system for operating the appliance 14.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator comprising:

a cabinet defining a refrigerated compartment and a machine compartment at a rear of the cabinet;

a compressor disposed within the machine compartment, the compressor adapted to compress a refrigerant within a refrigerant line;

a micro-channel condenser positioned in communication with the compressor and adapted to selectively reject heat from the refrigerant into the machine compartment; and a condenser fan positioned within the machine compartment between the micro-channel condenser and the compressor, the condenser fan adapted to draw a stream of heated air through the micro-channel condenser, via a rear vent, and also draw a separate stream of fresh air from a front area of the cabinet and through a fresh air duct that is adjacent the machine compartment, the front area being beneath the refrigerated compartment, wherein the stream of heated air and the separate stream of fresh air combine within a mixing space downstream of the micro-channel condenser to define mixed air that is directed through the condenser fan and toward the compressor for cooling the compressor, wherein the microchannel condenser is positioned within a condenser wall that separates the rear vent from the fresh air duct, and wherein the separate stream of fresh air does not undergo a heat exchange process upstream of the mixing space and under the refrigerated compartment.

2. The refrigerator of claim 1, wherein the micro-channel condenser is positioned at an angle with respect to a rear wall of the machine compartment.

3. The refrigerator of claim 2, wherein a leading edge of the micro-channel condenser engages the rear wall and extends at a 45 degree angle away from the compressor.

4. The refrigerator of claim 3, wherein the machine compartment includes a front wall, the front wall defining the fresh air duct for delivering the separate stream of fresh air from the front area of the cabinet and into the mixing space to be mixed with the stream of heated air.

5. The refrigerator of claim 4, wherein the machine compartment includes a side vent positioned in a first side wall of the cabinet adjacent to the micro-channel condenser, wherein process air is selectively delivered at least from an area external of the machine compartment to the micro-channel condenser via the side vent.

6. The refrigerator of claim 5, wherein the rear wall includes the rear vent that extends from an edge of the rear wall proximate the first side wall to an area proximate the leading edge of the micro-channel condenser.

7. The refrigerator of claim 6, wherein the micro-channel condenser is disposed within the condenser wall, the condenser wall at least partially defining the fresh air duct.

8. The refrigerator of claim 7, further comprising:

a sound insulation member disposed proximate the front wall of the machine compartment, wherein the sound insulation member defines a gap that characterizes an air exhaust of the machine compartment.

9. A heat rejection system for an appliance, the heat rejection system comprising:

a cabinet defining a machine compartment disposed at a rear of the cabinet and proximate a refrigerated compartment;

a linear compressor disposed within the machine compartment, the linear compressor adapted to compress a refrigerant within a refrigerant line, the refrigerant line in thermal communication with the refrigerated compartment;

a condenser of the refrigerant line positioned at an angle with respect to an axis of the linear compressor, the condenser in thermal communication with at least an exterior surface of the linear compressor, the condenser adapted to reject heat from the refrigerant and deliver the heat to a stream of process air to define a stream of heated air; and a condenser fan positioned between the condenser and the linear compressor, the condenser fan adapted to draw the stream of heated air from the condenser and also draw a separate stream of fresh air from an area laterally adjacent to the machine compartment and under a front portion of the refrigerated compartment via a fresh air duct, wherein the stream of heated air and the separate stream of fresh air combine within a mixing space defined between the condenser, the fresh air duct and the condenser fan to define mixed air that is directed toward the linear compressor for cooling the exterior surface of the linear compressor, wherein the stream of heated air enters the mixing space through the condenser and the separate stream of fresh air enters the mixing space via the fresh air duct, wherein a condenser wall includes the condenser and separates the stream of process air from the separate stream of fresh air, and wherein the separate stream of fresh air does not undergo a heat exchange process upstream of the fresh air duct and under the front portion of the refrigerated compartment.

10. The heat rejection system of claim 9, wherein the condenser is a micro-channel condenser.

11. The heat rejection system of claim 9, wherein the condenser engages a rear wall of the machine compartment and extends at a 45 degree angle away from the linear compressor.

12. The heat rejection system of claim 9, wherein the machine compartment includes a front wall, the front wall defining the fresh air duct for delivering the separate stream of fresh air to be mixed with the stream of heated air.

13. The heat rejection system of claim 9, wherein the machine compartment includes a side vent positioned in a first side wall of the cabinet adjacent the condenser, wherein the stream of process air is selectively delivered at least from an area external of the machine compartment to the condenser via the side vent.

14. The heat rejection system of claim 13, wherein a rear wall of the machine compartment includes a rear vent that extends from an edge of the rear wall proximate the first side wall to an area proximate a leading edge of the condenser.

15. The heat rejection system of claim 14, wherein the condenser wall at least partially defines the fresh air duct within a front wall of the machine compartment.

16. The heat rejection system of claim 9, further comprising:

a sound insulation member disposed proximate a front wall of the machine compartment, wherein the sound insulation member defines a gap that characterizes an air exhaust of the machine compartment.

17. The heat rejection system of claim 9, wherein the condenser fan is positioned to define a rotational axis that is substantially parallel with the axis of the linear compressor.

18. A heat rejection system for an appliance, the heat rejection system comprising:

a linear compressor adapted to compress a refrigerant within a refrigerant line;

a micro-channel condenser of the refrigerant line positioned at a 45 degree angle with respect to a linear axis of the linear compressor, the micro-channel condenser in thermal communication with at least an exterior surface of the linear compressor, the micro-channel condenser adapted to reject heat from the refrigerant delivered through the micro-channel condenser and deliver the heat to a stream of process air to define a stream of heated air; and a condenser fan positioned between the micro-channel condenser and the linear compressor and proximate a leading edge of the micro-channel condenser, the condenser fan adapted to draw the stream of heated air from the micro-channel condenser and also draw a separate stream of fresh air from a fresh air vent positioned adjacent to a trailing edge of the micro-channel condenser, wherein the stream of heated air and the separate stream of fresh air combine at a mixing space defined between the micro-channel condenser, the fresh air vent and the condenser fan to define mixed air that is directed toward the linear compressor for cooling the exterior surface of the linear compressor, wherein a condenser wall includes the condenser and separates the stream of process air from the separate stream of fresh air, wherein the separate stream of fresh air enters the mixing space directly from the fresh air vent, and wherein the separate stream of fresh air does not undergo a heat exchange process upstream of the fresh air vent.

19. The heat rejection system of claim 18, wherein the linear compressor, micro-channel condenser and condenser fan are positioned within a machine compartment of an appliance cabinet and adjacent to an interior compartment, and wherein a vent space is disposed under the interior compartment and defined by a front wall of the machine compartment, wherein the fresh air vent is defined within the front wall of the machine compartment and the condenser fan draws the separate stream of fresh air from the vent space.

20. The heat rejection system of claim 19, wherein the machine compartment includes the condenser wall that extends from a rear wall of the machine compartment and extends to the front wall of the machine compartment, and wherein the micro-channel condenser is positioned within the condenser wall, and the trailing edge of the micro-channel condenser is at a 45 degree angle distal from the linear compressor, and wherein the condenser fan is positioned to define a rotational axis that is substantially parallel with the linear axis of the linear compressor.

* * * * *